United States Patent [19]

Davis et al.

[11] Patent Number: 4,805,707

[45] Date of Patent: Feb. 21, 1989

[54] WRECKING APPARATUS

[76] Inventors: Dennis W. P. Davis, 4624 W. 128th St., Alsip, Ill. 60658; Timothy Tough, 8400 S. 84th Ct., Hickory Hills, Ill. 60457

[21] Appl. No.: 140,927

[22] Filed: Dec. 30, 1987

Related U.S. Application Data

[63] Continuation of Ser. No. 871,823, Jun. 9, 1986, abandoned.

[51] Int. Cl.[4] ..... B25D 17/24

[52] U.S. Cl. ..... 173/139; 248/635; 248/580; 173/162.1

[58] Field of Search ..... 81/22; 403/224, 225; 248/345.1, 635, 580, 560; 173/29, 139, 162.1

[56] References Cited

U.S. PATENT DOCUMENTS

| | | | |
|---|---|---|---|
| 3,091,159 | 5/1963 | Miller | 404/133 |
| 3,150,724 | 9/1964 | Oelkers | 173/100 |
| 3,308,730 | 3/1967 | Vorwald | 404/133 |
| 3,658,384 | 4/1972 | Gluszek | 173/29 |
| 3,807,802 | 4/1974 | Betters | 173/29 |
| 3,823,786 | 7/1974 | Voitsekhovsky et al. | 173/126 |
| 4,121,777 | 10/1978 | Kolstad et al. | 241/101.7 |
| 4,240,763 | 12/1980 | Moore | 403/225 X |
| 4,388,018 | 6/1983 | Boschung | 404/133 |
| 4,457,645 | 7/1984 | Klochko | 404/133 |

*Primary Examiner*—Frank T. Yost
*Assistant Examiner*—James L. Wolfe
*Attorney, Agent, or Firm*—James N. Videbeck

[57] ABSTRACT

A wrecking implement for attachment to the lift mechanisms of a loader machine comprises a generally rectangular plate having a mounting tube projecting therefrom. A boom having a hammer head carried on its distal end is telescopingly received within the mounting tube such that it extends outwardly of the plate and loader machine. Resilient pads are interposed between the boom and mounting tube and the boom has a metal tubular sleeve transversely through one end thereof which is secured to the mounting tube by passing a bolt through the metal tubular sleeve facilitating limited pivotable movement of the boom relative to the mounting tube and plate. A resilient tubular sleeve is positioned between the bolt and the metal tubular sleeve. The boom is thereby operable by the lift mechanisms of the loader machine to deliver impact blows to concrete or other structures intended to be demolished, and considerable mass may be associated with the hammer head inasmuch as the pads and resilient tubular sleeve serve to dampen a substantial degree of the vibration imparted to the boom during a wrecking operation.

10 Claims, 2 Drawing Sheets

WRECKING APPARATUS

This application is a continuation of application Ser. No. 871,823, filed June 9, 1986, now abandoned.

BACKGROUND OF THE INVENTION

1. Field of the Invention

The present invention relates generally to an improved wrecking apparatus for demolishing concrete structures or the like, and it relates more particularly to a new and improved wrecking implement for convenient attachment to a conventional loader machine.

2. Description of the Prior Art

Buildings and other man-made structures which have reached the end of their useful lives or have become uneconomical to maintain are frequently demolished and removed with the aid of construction machinery of various types. Particularly where the structure has a concrete composition, such as in the case of sidewalks, pavement, curbs and building foundations, impact machinery capable of wrecking the structures and breaking them into manageable pieces for removal is virtually a necessary expedient to any cost effective removal project. A type of impact machine currently in widespread use in the demolition of concrete structures is a pneumatically operated jack hammer device. Such a device has long been available in numerous forms. In one such form, a jack hammer which is capable of being manipulated by an individual operator includes a relatively lightweight housing from which a reciprocating bull point demolition tool extends. Where increased production is desired, yet another form of jack hammer is known wherein the hammer assembly is a relatively heavy structure and is adapted to be mounted to the boom of a backhoe or similar piece of construction machinery. In each of these foregoing examples, the impact force of the hammer is provided by a mechanism which requires for its operation a source of compressed air. Accordingly, a separate compressor unit, usually gasoline driven, must be furnished with the jack hammer to accomplish a demolition or wrecking project, and therefore, a large project typically involves the commitment of multiple pieces of complex machinery.

Recently, a new piece of machinery, known as the skid steer loader, has gained wide acceptance in the construction industry generally. Broadly described, the skid steer loader is a relatively small, high-lift machine having a centrally positioned cab for occupancy of an individual operator. On each side of the cab are pairs of rubber tire wheels driven individually through a transmission by a rear mounted power plant. A forward bucket is suspended from a pair of lifting arms which pivot from points located near the rear of the loader cab. Among the features of this machine are that it has virtually zero turning radius and has an unusually high reach for its relatively small size. Thus, the machine is readily maneuverable in close places and is highly efficient in performing construction tasks of various types.

A typical pneumatic jack hammer is available for attachment to a skid steer loader when it is desired that the loader be used for demolition or wrecking of concrete structures. However, as in the case of other jack hammers as heretofore described, a separate compressor unit must be supplied with the loader when concrete demolition is undertaken. Another disadvantage of pneumatically driven jack hammers in the demolition of concrete structures is that, in general, they involve a time consuming effort because the wrecking tool of the hammer must necessarily be a relatively low mass structure in order to be reciprocatingly driven by a pneumatically operated mechanism. Accordingly, jack hammer devices are effective in demolishing concrete only in a highly localized manner producing relatively small pieces of demolished debris.

SUMMARY OF THE INVENTION

To overcome the foregoing disadvantages of pneumatically driven jack hammers in the demolition of concrete structures, briefly, there is provided in accordance with the teachings of the present invention a new and improved wrecking implement for attachment to a loader machine, comprising a generally rectangular plate having a mounting tube secured thereto. A boom having a distal end and a proximal end is provided with its distal end carrying hammer means for delivering an impact blow to a structure being demolished. The proximal end of the boom is telescopingly received within the mounting tube and means are provided for cushioning the boom within the mounting tube. The boom is secured to the mounting tube by a bolt and sleeve arrangement for limited pivotable movement of the boom against the cushioning means. By such an arrangement, considerable mass can be associated with the hammer means for delivering impact blows of relatively high proportion notwithstanding that the implement is capable of being used with a relatively small loader machine, such as a skid steer loader. Moreover, the mounting tube and cushioning means arrangement serves to assist substantially in isolating vibration forces from the loader machine and the operator.

BRIEF DESCRIPTION OF THE DRAWINGS

The foregoing and other novel features of the present invention will be better understood by a reading of the following detailed description taken in connection with the accompanying drawings wherein.

DETAILED DESCRIPTION OF THE PREFERRED EMBODIMENT

Figure 1:
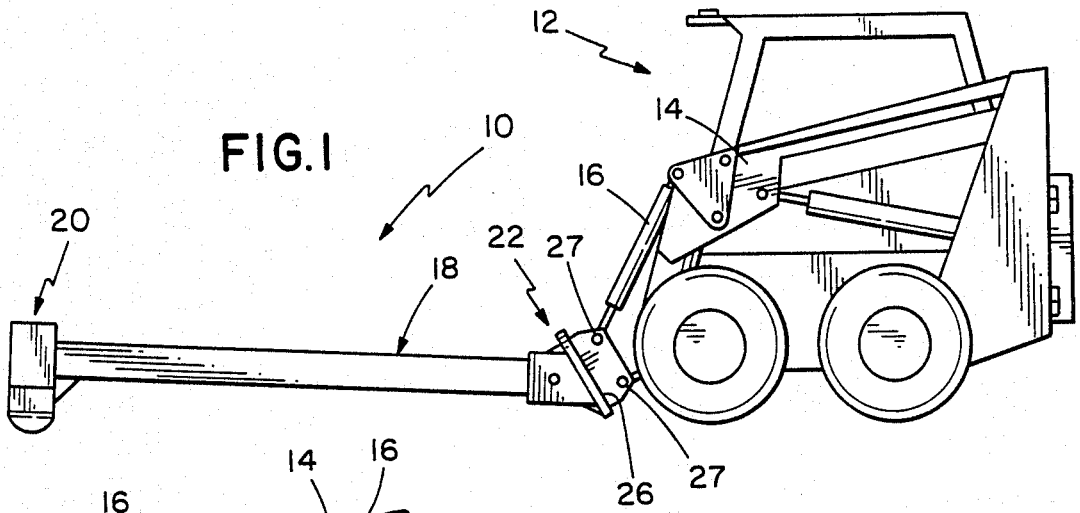
FIG. 1 is an elevational view of a loader machine equipped with a wrecking implement constructed in accordance with the principles of the invention.

Turning now to the drawings, and initially to FIG. 1, a wrecking implement in accordance with the present invention, designated generally by the reference numeral 10, is shown as attached to a typical loader machine, designated generally by the reference numeral 12. Although the illustrated loader machine 12 is of the skid steer type, it should be understood that the wrecking implement 10 of the instant invention is equally suitable for use with other types of construction machinery having lifting mechanisms and, accordingly, it is not intended to limit the invention to skid steer machine applications. The loader machine 12 is typically adapted for use with a loading bucket (not shown) and, to this end, is provided with a pair of lifting arms, 14, only one of which can be seen in FIG. 1, and hydraulic cylinders 16 which function at the control of the machine operator to tilt the bucket or other attachments. The wrecking implement 10 comprises as its principal components a generally elongate boom 18 projecting away from the loader machine 12 and having a distal end fitted with a hammer assembly, designated generally by the reference numeral 20, and a proximal end fitted with an assembly for attaching the boom 18 to the machine 12, the attachment assembly being designated generally by the reference numeral 22.

Figure 2:
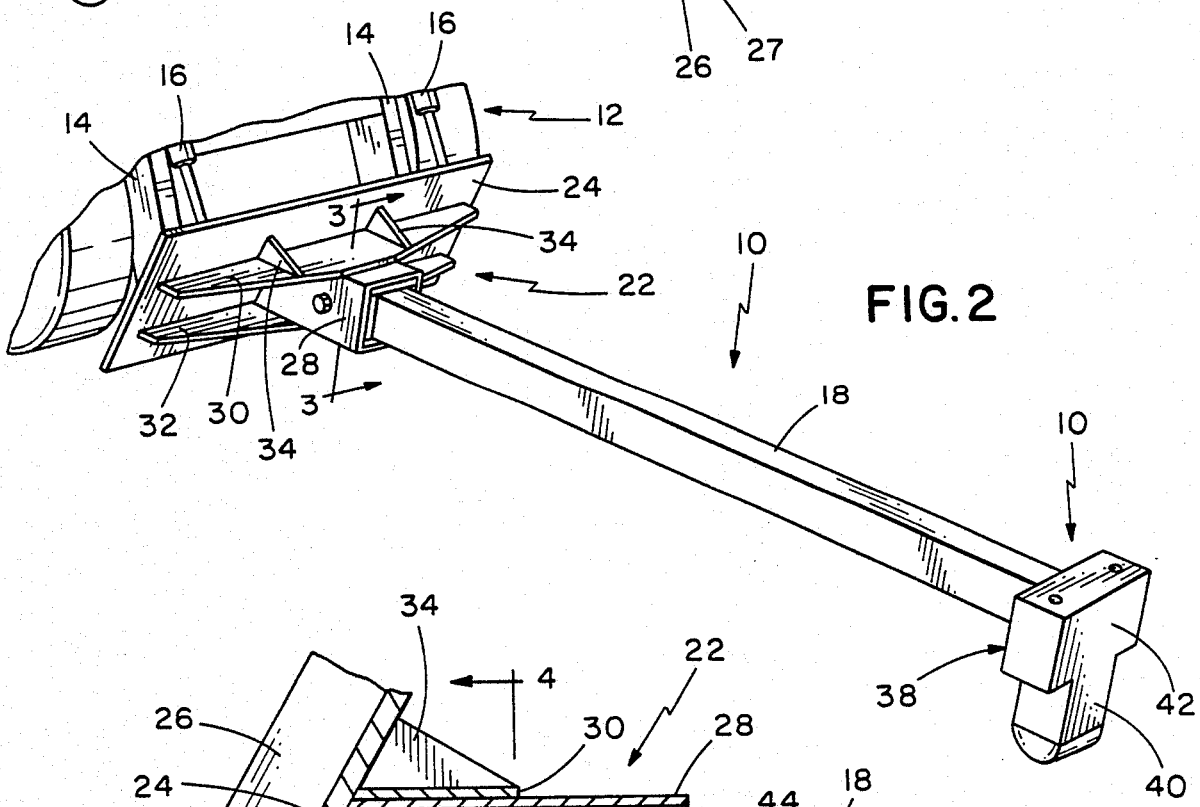
FIG. 2 is a perspective view of the wrecking implement illustrated in FIG. 1.

With reference now particulary to FIG. 2, the overall details of the wrecking implement attachment assembly can be seen to include a generally rectangular, rigid plate member 24 which is selectively coupled to the lifting arms 14 and hydraulic cylinders 16 of the loader machine 12 by means of suitable rearwardly extending spaced brackets 26 and pins 27, as best seen in FIG. 1. Positioned centrally of the plate member 24 and extending forwardly therefrom is a mounting tube 28 into which the boom 18 is telescopingly received. The mounting tube 28 is preferably constructed of seamless square steel tubing and is secured to the plate member 24 as by welding. As illustrated, the longitudinal axis of the mounting tube 28 may be inclined at an acute angle to the surface of the plate 24 in order to appropriately accommodate the geometric requirements of the lifting arms 14 and hydraulic cylinders 16, respectively, of the loader machine 12. In order to reinforce the attachment of the mounting tube 28 to the plate member 24, a pair of forwardly facing bracket members 30, 32 are secured to the upper wall and lower wall, respectively, of the mounting tube 28 and, in turn, are welded to the forward face of the plate member 24. Further reinforcement of the attachment assembly 22 is provided by pairs of gussets 34, 36 welded between the bracket members 30, 32 and the plate member 24, respectively. Like the mounting tube 28, the boom 18 is preferably constructed of seamless square steel tubing and, in the preferred embodiment, has a length on the order of twice the wheel base of the loader machine 12. The hammer assembly 20 depending from the distal end of the boom 18 comprises a T-shaped hammerhead 38, the downwardly extending leg of which serves as a wrecking point 40 and the cross portion of which serves as a weight 42.

Figure 3:
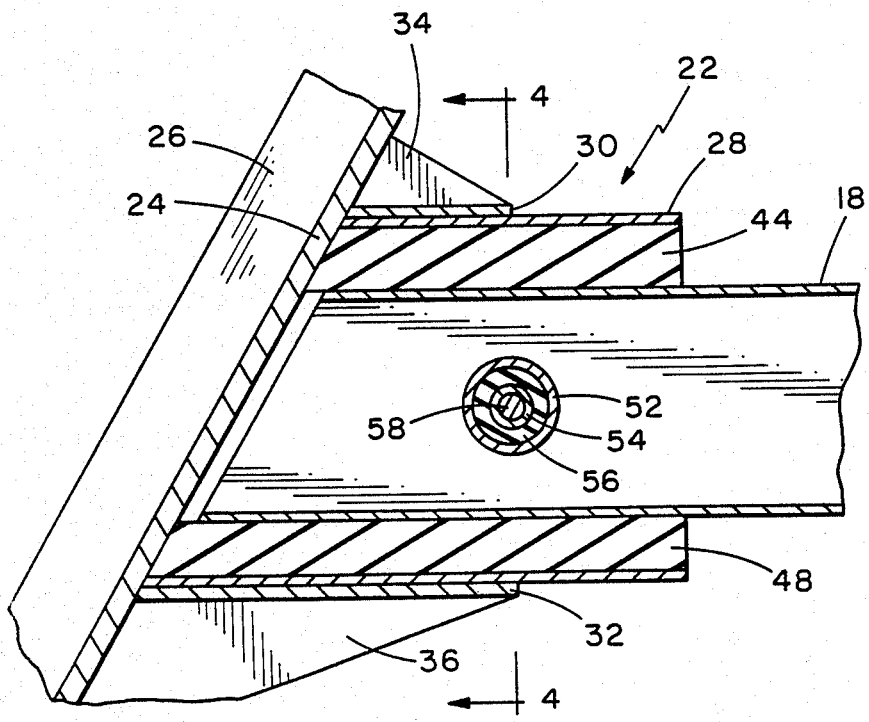
FIG. 3 is a partial sectional view taken along the lines 3—3 of FIG. 2.
Figure 4:
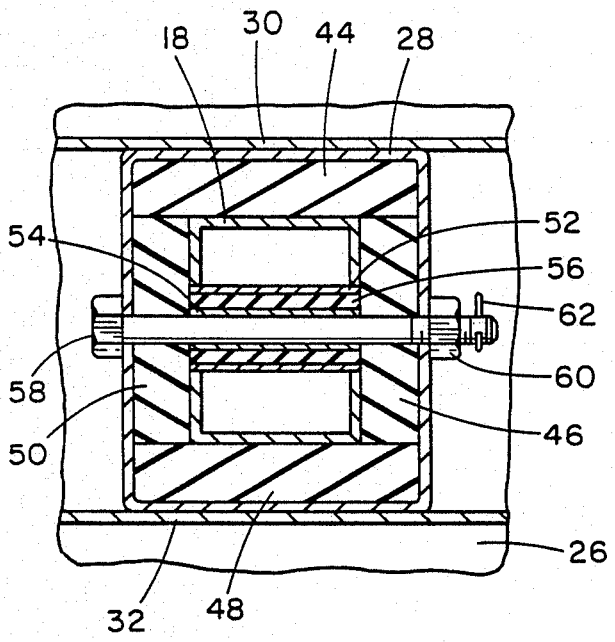
FIG. 4 is a partial sectional view taken along the lines 4—4 of FIG. 3.

With reference now to FIGS. 3 and 4, the attachment assembly 22 for the boom 18 is provided, in accordance with the present invention, with a cushioning feature whereby the boom 18 is sized with outside wall dimensions which are substantially less than the inside wall dimensions of the mounting tube 28, and interposed between the boom 18 and mounting tube 28 are pads 44, 46, 48 and 50. In addition, the boom 18 is fitted with a steel sleeve 52 providing a transverse cylindrical opening through which a second steel sleeve 54 may be concentrically positioned. The interior sleeve 54 is considerably smaller in outside dimension than the inside dimension of the exterior sleeve 52 and thereby a third sleeve 56 constructed of a resilient material is interposed in the space between the interior and exterior sleeves 54 and 52, respectively. In order to secure the boom 18 to the mounting tube 28, a suitable bolt 58 extends perpendicularly through the entire assembly of the mounting tube 28, the resilient pads 46 and 50, and the inner sleeve 54 of the boom 18 and is fastened firmly against the outside wall of boom 18 by an appropriate nut 60 and cotter pin 62. IT can be appreciated particularly from the illustration of FIG. 4 that the foregoing arrangement provides for the complete three dimensional cushioning of the beam 18 thereby isolating vibration of the beam 18 from transmission to the mounting tube 28 and, as a consequence, significantly reduces vibration transmitted to the loader machine 12 itself. Another feature of this arrangement is that a single transverse mounting bolt 58 for the beam 18 permits the beam 18 to pivot slightly in a vertical plane against the upper pad 44 and the lower pad 48 whereupon vibration effects transmitted to the mounting tube 28 and machine 12 are further reduced.

Figure 5:
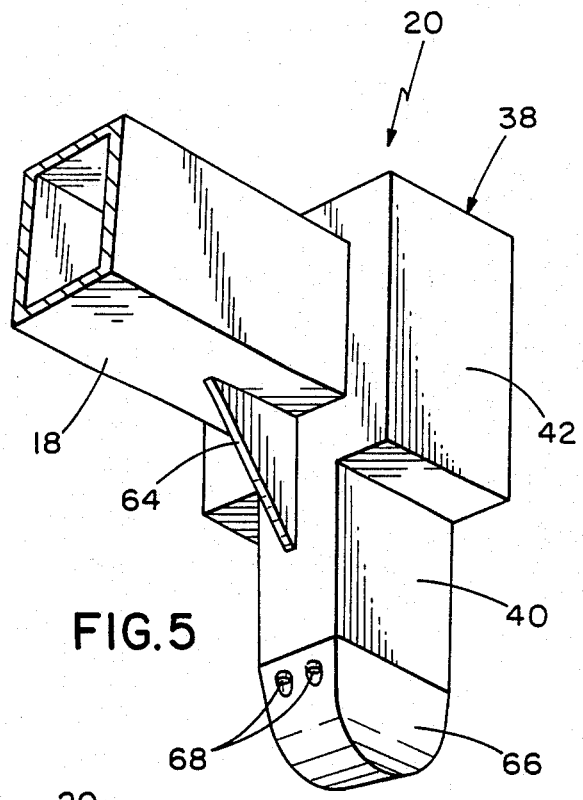
FIG. 5 is a partial perspective view of the hammer end of the wrecking implement of the present invention.
Figure 6:
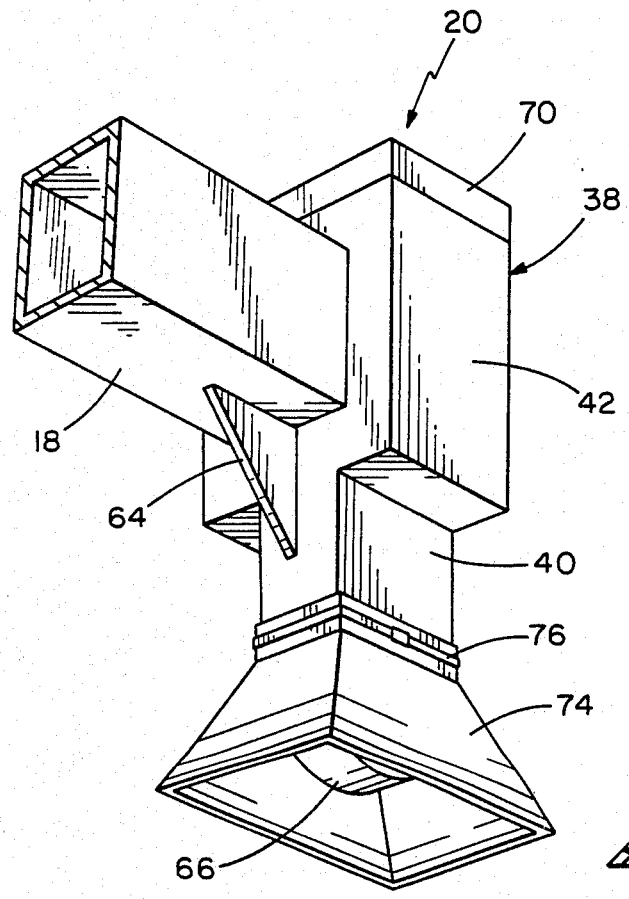
FIG. 6 is a partial perspective view of the hammer end of the wrecking implement of the present invention illustrating the use of a skirt member surrounding the impact point of the hammerhead.
Figure 7:
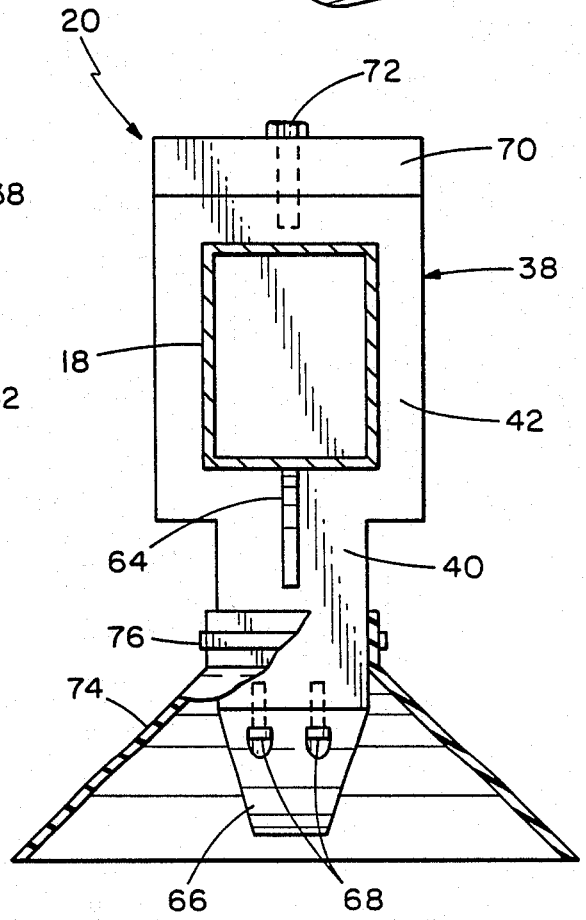
FIG. 7 is an elevational view, partially broken away, of the hammerhead assembly illustrated in FIG. 6.

The hammer assembly 20 can be seen in detail in the perspective views of FIGS. 5, 6 and 7 illustrating alternative embodiments thereof. For reinforcement, the hammerhead 38 is preferably secured to the boom 18 with gusset means 64. As an additional feature of the wrecking implement 10, the wrecking point 40 may include a detachable hardened tip 66 secured to the point 40 by suitable recessed bolts 68. A tip 68, for example, may be fabricated from a case hardened steel material, or may be provided with a hardened overlay material such as tube borium. In order to increase the mass of the hammer assembly 20, separate weight members 70 may be fastened by bolts 72 to the upper surface of the hammerhead 38, as best seen in FIGS. 6 and 7. Further illustrated in FIGS. 6 and 7 is a resilient skirt 74 connected to the wrecking point 40 of the hammerhead 38 by a typical strap 76. The skirt 74 extends slightly beyond the tip 66 of the wrecking point 40 serving to enshroud the tip 66 preventing debris from being propelled outwardly from the hammerhead 38 when it is delivering an impact blow.

OPERATION

In operation of the instant wrecking implement 10, the bucket of a typical loader machine, such as the machine 12 illustrated in FIG. 1, is simply uncoupled from the machine 12 by removal of the pins 27 which secure the bucket to the lifting arms 14 and hydraulic cylinders 16. The machine 12 is then moved into position with respect to the wrecking implement 10 such that the lifting arms 14 and hydraulic cylinders 16 can be recoupled by pinning to the brackets 26 of the attachment assembly 22. The boom 18 and thus the hammerhead 38 can thereafter be both lifted and pivoted utilizing the standard hydraulic controls of the machine 12, the control technique being largely similar to that used in operating the machine 12 with a bucket attached thereto. Downward movement of the boom 18, of course, causes the hammerhead 38 to deliver an impact blow to the structure toward which the machine 12 and operator are facing. Since the boom 18 is a relatively long member, substantial impact forces can be imparted to the hammerhead 38 by the very speed at which the hammerhead 38 travels as it is lowered toward the structure to be demolished. In addition, the length of the beam 18 permits the machine 12 to be used at a distance from the structure to be demolished offering considerable advantages in the removal of sidewalks, for example, whereby the machine 12 can be positioned away from the sidewalk on the adjacent street pavement. Moreover, with a highly maneuverable loader machine 12, such as a skid steer loader, the hammerhead 38 in the configuration illustrated herein, can also be used to push, pull or rake debris following the demolition process. Thus, the wrecking implement 10 and loader machine 12 of the instant invention offer significant advantages over jack hammer type demolition and wrecking equipment. The cushioning feature of the instant attachment assembly 22, as heretofore described, permits the wrecking implement to be operated over numerous duty cycles without undue damage to the loader machine 12 and without trauma to the operator thereof. Accordingly, the machine 12 and wrecking implement 10 can be operated over extended periods of time without appreciably strain to the operator. The implement 10 thus provides a highly cost effective means for wrecking and demolishing structures of various types which require removal prior to their replacement.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed as new and desired to be secured under Letters Patent of the United States is:

1. A wrecking implement for attachment to a loader machine, comprising:

a base plate operably connectable on said loader machine;

a boom mounting member secured on said plate;

a boom having a distal end and a proximal end;

the proximal end being selectably releasably retained on said boom mounting member;

means for securing said boom on said mounting member;

cushioning means for three directional cushioning of said boom with respect to said mounting member; and hammer means depending from said distal end of said boom.

2. The wrecking implement of claim 1 further comprising a pair of bracket means for securing said mounting member to said plate, said bracket means each being attached to an opposite side of said mounting member and extending longitudinally of said plate.

3. The wrecking implement of claim 1 wherein said cushioning means include at least one resilient pad member interposed between said boom and said mounting for dissipating vibration from said boom.

4. The wrecking implement of claim1 wherein said means for securing said boom comprises a bolt and a sleeve transversely mounted through said proximate end of said boom, said bolt being extensible axially through said sleeve in spaced relation thereto.

5. The wrecking implement of claim 4 wherein said cushioning means includes a resilient tubular member interposed in said space between said bolt and said sleeve.

6. The wrecking implement of claim 4 wherein said hammer means include a T-shaped hammer head having a downwardly extending leg which serves as a wrecking point, and a portion of said hammerhead includes a mounting means adapted for securing additional weight on said hammer head.

7. The wrecking implement of claim 6 further including weight members selectively attachable on said hammerhead for increasing the mass of said hammer means.

8. The wrecking implement of claim 1 wherein said hammer means includes a hammer head including a downwardly extending leg and a striking point member selectively mountable to the distal end of said downwardly extending leg.

9. The wrecking implement of claim 8 further including a resilient skirt selectively attachable around the distal end of the downwardly extending leg of the hammerhead.

10. Wrecking apparatus comprising:

a loader machine;

a plate attached to said loader machine;

means associated with said loader machine for raising and lowering said plate;

means associated with said loader machine for tilting said plate;

a mounting tube rigidly secured to said plate and extending away from said loader machine;

a boom having a proximal end and a distal end, the proximal end being selectably releasably retained within said mounting tube;

means for directional cushioning said boom within said mounting tube;

means for selectively securing said boom to said mounting tube; and hammer means depending from said distal end of said boom.

* * * * *